US012102883B2

(12) United States Patent
Hoefler et al.

(10) Patent No.: US 12,102,883 B2
(45) Date of Patent: Oct. 1, 2024

(54) LEATHER COVERED GAME BALL

(71) Applicant: Rohm and Haas Company, Collegeville, PA (US)

(72) Inventors: Joseph Hoefler, Perkiomenville, PA (US); Michaeleen L. Pacholski, Collegeville, PA (US)

(73) Assignee: Rohm and Haas Company, Midland, PA (US)

( * ) Notice: Subject to any disclaimer, the term of this patent is extended or adjusted under 35 U.S.C. 154(b) by 0 days.

(21) Appl. No.: 18/684,995

(22) PCT Filed: Jun. 30, 2022

(86) PCT No.: PCT/US2022/073275
§ 371 (c)(1),
(2) Date: Feb. 20, 2024

(87) PCT Pub. No.: WO2023/044182
PCT Pub. Date: Mar. 23, 2023

(65) Prior Publication Data

US 2024/0269521 A1 Aug. 15, 2024

Related U.S. Application Data

(60) Provisional application No. 63/245,964, filed on Sep. 20, 2021, provisional application No. 63/314,493, filed on Feb. 28, 2022.

(51) Int. Cl.
*A63B 37/12* (2006.01)
*A63B 37/14* (2006.01)
(Continued)

(52) U.S. Cl.
CPC ..... *A63B 37/12* (2013.01); *A63B 37/14* (2013.01); *A63B 45/00* (2013.01);
(Continued)

(58) Field of Classification Search
CPC ..... A63B 37/12; A63B 37/14; A63B 45/00; A63B 2037/125; A63B 2102/18;
(Continued)

(56) References Cited

U.S. PATENT DOCUMENTS 3,740,366 A 6/1973 Sanderson et al.
4,346,890 A 8/1982 Kaminstein
(Continued)

FOREIGN PATENT DOCUMENTS

CN 103073967 A * 5/2013
CN 112251097 A * 1/2021
JP 05202466 6/2013

OTHER PUBLICATIONS

Translation to English of CN103073967 via the FIT database in SEARCH. accessed Aug. 7, 2024 (Year: 2013).*
(Continued)

*Primary Examiner* — Nancy R Johnson
(74) *Attorney, Agent, or Firm* — Edward W. Black

(57) ABSTRACT

A game ball including a leather cover secured about a solid core, wherein the leather cover includes an inner surface contacting the solid core and an opposing outer surface and wherein the game ball is characterized by including polyacrylate particles dispersed on but not encased about the outer surface of the leather cover.

11 Claims, 1 Drawing Sheet

(51) Int. Cl.
*A63B 45/00* (2006.01)
*A63B 102/18* (2015.01)

(52) U.S. Cl.
CPC ..... *A63B 2037/125* (2013.01); *A63B 2102/18* (2015.10); *A63B 2102/182* (2015.10); *A63B 2209/00* (2013.01)

(58) Field of Classification Search
CPC . A63B 2102/182; A63B 2209/00; B32B 7/02; B32B 7/022; B32B 2264/301; B32B 2264/302; B32B 2307/744; B32B 3/30; C09D 133/08; C09D 133/10; C09D 133/12; C09D 5/03; C09D 5/031; C09D 5/032; Y10T 428/24372; Y10T 428/24405
See application file for complete search history.

(56) References Cited

U.S. PATENT DOCUMENTS

| | | | | |
|---|---|---|---|---|
| 4,454,253 | A | 6/1984 | Murphy et al. | |
| 4,666,094 | A | 5/1987 | Rockerath | |
| 4,689,832 | A | 9/1987 | Mulvaney | |
| 5,069,935 | A | 12/1991 | Walters | |
| 5,091,265 | A | 2/1992 | Kennedy et al. | |
| 5,204,088 | A | 4/1993 | Noebel et al. | |
| 5,461,125 | A | 10/1995 | Lu et al. | |
| 5,664,774 | A | 9/1997 | Walker et al. | |
| 6,190,273 | B1 | 2/2001 | Maxey et al. | |
| 6,458,052 | B1 | 10/2002 | Pitsenberger et al. | |
| 6,471,885 | B2 | 10/2002 | Chiang et al. | |
| 6,639,024 | B2 | 10/2003 | Simonds et al. | |
| 7,063,747 | B2 | 6/2006 | Lastowka | |
| 7,323,500 | B2 | 1/2008 | Schindler et al. | |
| 7,867,116 | B2 | 1/2011 | Guenther et al. | |
| 7,882,717 | B2 * | 2/2011 | Widdemer | A43B 23/0225 69/21 |
| 8,309,615 | B2 | 11/2012 | Hoefler | |
| 8,771,114 | B2 | 7/2014 | Markovich et al. | |
| 9,205,310 | B1 | 12/2015 | Hampton | |
| 9,999,810 | B2 | 6/2018 | Fang | |
| 10,058,743 | B2 | 8/2018 | Smith | |
| 10,100,377 | B2 | 10/2018 | Eryazici et al. | |
| 10,184,062 | B2 | 1/2019 | Einsla et al. | |
| 10,421,877 | B2 | 9/2019 | Lafleur et al. | |
| 10,773,133 | B2 | 9/2020 | Fang | |
| 2009/0111934 | A1 * | 4/2009 | Yuan | C09D 175/04 524/507 |
| 2010/0151971 | A1 | 6/2010 | Mydlack et al. | |
| 2011/0160011 | A1 | 6/2011 | Wilson | |
| 2014/0066238 | A1 | 3/2014 | Smith et al. | |
| 2015/0361208 | A1 | 12/2015 | Wang et al. | |
| 2016/0008671 | A1 | 1/2016 | Bhargava et al. | |
| 2019/0299065 | A1 | 10/2019 | Fang | |
| 2023/0001449 | A1 * | 1/2023 | Pope | A63B 47/008 |

OTHER PUBLICATIONS

Translation to English of CN112251097 via the FIT database in SEARCH. accessed Aug. 7, 2024 (Year: 2021).*
Springer, "Get a Grip", The Hardball Times, 2017, pp. 1-10.
Yamaguchi, "Effects of Rosin Powder Application on the Frictional Behavior Between a Finger Pad and Baseball", Frontiers in Sports and Active Living, 2020, vol. 2.

* cited by examiner

LEATHER COVERED GAME BALL

CROSS REFERENCE TO RELATED APPLICATIONS

This application is a U.S. national stage filing under 35 U.S.C. § 371 of PCT Application no. PCT/US2022/073275 filed on 30 Jun. 2022, currently pending which claims the benefit of U.S. Provisional Patent Application Ser. No. 63/245,964 filed on 20 Sep. 2021 and U.S. Provisional Patent Application Ser. No. 63/314,493 filed on 28 Feb. 2022 under 35 U.S.C. § 119 (e). PCT Application no. PCT/US2022/073275 and U.S. Provisional Patent Application Ser. Nos. 63/245,964 and 63/314,493 are hereby incorporated by reference.

FIELD

This invention relates to game balls including a leather covered solid core, e.g., baseballs and softballs.

INTRODUCTION

New leather covered game balls are commonly rubbed with mud compounds to reduce sheen and improve grip prior to use. The mudding process is time consuming and results in inconsistent results due to variations in mud compositions and mudding techniques. After mudding, the ball's outer surface is discolored making it more difficult for hitters to see along with making the detection of adulterants (e.g., unsanctioned materials used to improve grip) more challenging.

Rosins have been used by athletes (e.g., weight-lifters, rock-climbers, baseball players, etc.) to improve hand grip. These materials typically comprise a pine resin and metal salt (e.g. magnesium chloride) that are applied directly to the hand or glove. While rosins have been shown to improve the friction coefficient between fingers and a baseball in wet conditions, the effect is less apparent in dry conditions. See T. Yamaguchi, et al., "Effects of Rosin Powder Application on the Frictional Behavior Between a Finger Pad and Baseball," Frontiers in Sports and Active Living 2:30 (2020). In practice, the improved grip offered by rosins is non-durable and requires regular reapplication.

Polymeric coatings have been used with game balls to impart improved weather resistance and/or fluorescence. Such coatings are most commonly used with game balls including synthetic leather covers. Examples include polyurethane materials which are coated in multiple layers and cured after application upon the outer surface of the game ball. The resulting coating layers are several mils thick. Similar post-cured polyurethane coatings have also been described as protective covers for golf balls. By way of example, U.S. Pat. No. 5,091,265 describes the use of weather resistant, fluorescent coatings for game balls. The composition includes two-part polyester polyol resin and a polyisocyanate resin, a fluorescent pigment and an organic solvent. The coating is applied and cured to form one or more crosslinked layers each having a thickness of 25 to 51 μm (1 to 2 mils). The coating may additionally include crystalline polypropylene to improve grip. While the thickness of the crosslinked composition protects the ball (e.g. provides weather resistance), it also encases the underlying cover of the ball. Thus, the texture and feel of the underlying cover is masked by the crosslinked polyurethane coating.

There remains an unmet need for leather covered game balls possessing a durable, uniform, pre-determined level of grip and which does not discolor the ball so that it remains highly visible for batters and is more conducive to detection of adulterants on the outer surface of the game ball.

SUMMARY

The present invention includes a game ball with a leather cover secured about a solid core, wherein the leather cover includes an inner surface contacting the solid core and an opposing outer surface. In one aspect of the invention, the game ball is characterized by including polyacrylate particles dispersed on but not encased about the outer surface of the leather cover. In another aspect of the invention, the outer surface of the leather cover is characterized by having a Fourier transform infrared (FTIR) spectra with peaks corresponding to both leather and polyacrylate. In another aspect of the invention, the outer surface of the leather cover is characterized by having an FTIR spectra with a peak intensity ratio between the polyacrylate and leather peaks from 0.10 to 50.0 and more preferably from 0.25 to 25.0. In still another aspect, the invention includes a method for making a game ball including the steps of: i) obtaining a game ball comprising a leather cover secured about a solid core, wherein the leather cover includes an inner surface contacting the solid core and an opposing outer surface and ii) dispersing polyacrylate particles on the outer surface of the leather cover. Many embodiments are described

BRIEF DESCRIPTION OF THE DRAWINGS

Various aspects of the invention may be better understood by reference to the following description taken in conjunction with the accompanying drawings. The depictions are illustrative and not intended to be to scale or otherwise limit the invention.

DETAILED DESCRIPTION

Figure 1:
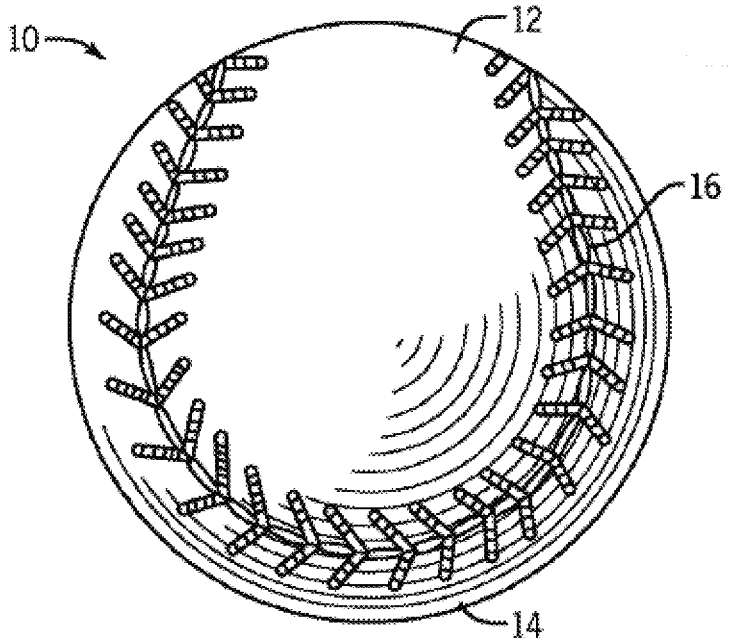
FIG. 1 is an elevational view showing an embodiment of the invention including a game ball (10) with a leather cover (12) comprising two panels (14) secured about a solid core (not shown) by stitching (16).
Figure 2:
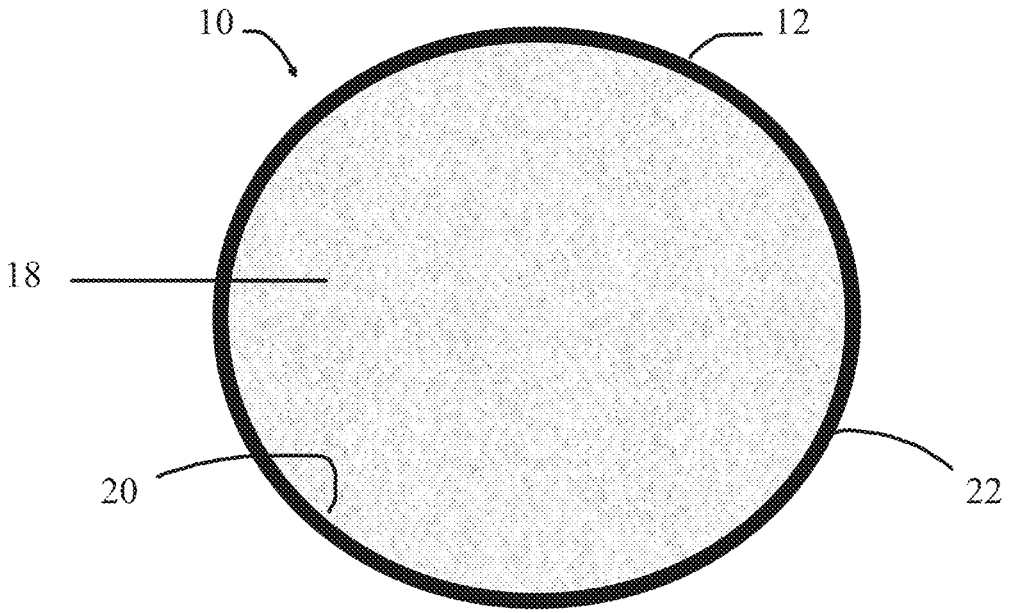
FIG. 2 is a cross-sectional view showing an embodiment of the invention including a game ball (10) with a leather cover (12) including an inner surface (20) in contact with a spherical solid core (18) and an opposing outer surface (22).

The game balls of the present invention include a leather cover secured about an inner solid core. The core is substantially spherically and preferably comprises cork, elastomer (e.g. polycarbonate, polyurethane, polyvinyl chloride, diene-based rubber, etc.) or combination thereof, e.g. a compressed cork sphere encased in one or more layers of rubber to form a unitary sphere. The core may be optionally wrapped with one or more layers of yarn, (e.g., wool, polyester, cotton, polyester-cotton blend, etc.) to form a spherical center which may be optionally covered with one or more outer layers of elastomer and/or an adhesive to facilitate placement of an outer leather cover. Representative leather cover materials include natural leathers such as cow and horse hide, e.g., grade A alum tanned, full-grain cow or horse hides. In one class of embodiments, the leather cover may be secured about the core by stitching. For example, by convention two pieces of leather pre-cut into "figure eight" configurations may be stitched together about the core. For baseballs, stitching typically includes 108 double stitches (by hand) using 10/5 red cotton sewing thread lubricated with bees wax. Other threads (e.g., KEVLAR™, polyester, nylon, etc.) and stitch patterns (herringbone pattern) may be used. Once assembled, the leather cover of the game ball includes an inner surface in contact with the core and an opposing outer surface intended to be handled by a player. As previously discussed, the characteristics of the outer surface of a game ball are important. In particular, the "grip" of the outer surface is important for achieving a proper level of control during pitching.

In one embodiment, the subject game balls are baseballs. While individual leagues may have different requirements, baseballs typically weigh from approximately 141 to 149 grams with an outer circumference of from approximately 22.8 to 23.5 cm. In yet another embodiment, the subject game balls are softballs. While similar to baseballs, the construction of the core is more commonly polyurethane rather than a rubber encased cork. Softballs typically have an outer circumference from approximately 30 to 30.8 cm and weight of approximately 177 to 199 grams.

The subject game balls are characterized by including polyacrylate particles dispersed on but not encased about (i.e., not encasing) the outer surface of the leather cover. As used herein, the term "encased about" and "encasing" means to form a continuous film or barrier on (about the outer circumference) the outer surface such that the texture of the underlying leather is encapsulated and no longer present to the touch. For purposes of the present invention, the polyacrylate particles do not form a continuous coating that completely masks the surface texture of the leather. This is in contrast with leather coatings described in the art which are typically applied in multiple layers each more than 1 mil thick. In such known coatings, the "grip" afforded by the surface texture of the leather is masked and the resulting haptics are dictated by the material used in the coating rather than the texture of the leather. In a preferred embodiment of the present invention, the aforementioned polyacrylate particles are also dispersed upon the stitching used to secure the leather cover about the core of the ball.

In a one class of embodiments, the outer surface of the leather cover is characterized by having a Fourier transform infrared (FTIR) spectra with peaks corresponding to both leather and polyacrylate. For leather, the amide carbonyl peak between 1630 to 1655 $cm^{-1}$ (1643 $cm^{-1}$) is a useful identifier. For the 0.30 polyacrylate, the acrylic ester carbonyl peak between 1725 to 1740 $cm^{-1}$ (1732 $cm^{-1}$) is a useful identifier. In both cases, peak intensities are calculated on spectra represented as absorbance units using a baseline of 1505 to 1830 $cm^{-1}$. In another embodiment, the peak intensity ratio between the polyacrylate and leather peaks is from 0.10 to 50.0 and more preferably from 0.25 to 25.0. The FTIR analysis is conducted using a Thermo Nicolet iS50 Fourier Transfer Infrared (FTIR) spectrometer with integrated single-bounce diamond Attenuated Total Reflectance (ATR) accessory using the following data collection parameters:

| | |
|---|---|
| Number of sample scans | 64 |
| Resolution: | 4.000 |
| Levels of zero filling | 2 |
| Number of scan points | 16672 |
| Number of FFT points: | 65536 |
| Apodization | N-B strong |
| Phase correction | Mertz |
| Number of background scans | 64 |
| Background gain | 1.0 |

The sampling method includes: i) collecting a background spectrum, ii) pressing the outer surface of the leather cover of the game ball against the ATR crystal and iii) measuring the spectrum.

The polyacrylate particles are preferably dispersed homogenously on the outer surface of the leather cover. In this context, the term "homogenously" means that both leather and polyacrylate FTIR peaks are detectable on at least three, four and preferably six sample locations wherein each sample location includes a 1.5 mm diameter circle located on the outer surface of the leather cover at equal distant locations from one another (e.g. top, bottom, front, back, left and right). In another embodiment, the aforementioned FTIR peak values and peak ratios are based upon an FTIR analysis using an average of the aforementioned six sample locations.

In another embodiment, the leather cover (and optionally threads) of the game ball comprises from 10 to 150 mg, 10 to 100 mg, 20 to 90 mg, 30 to 80 mg or 40 to 70 mg of polyacrylate particles dispersed thereon. The total quantity of polyacrylate present can be determined by measuring the difference in weight of an untreated (new) ball and the weight of the ball immediately after treatment (i.e. after application of an aqueous emulsion of the polyacrylate to the outer surface of the leather cover). This difference in weight is then multiplied by the % solids (polyacrylate) of the aqueous emulsion used to treat the ball.

When dispersed at the above indicated quantities, the subject polyacrylate provides the outer surface of the leather cover with improved hand "grip" while maintaining a significant aspect of the nature texture of the leather. This technical effect provides a pitcher with sufficient grip for adequate control while avoiding too much grip as to present a significant change (e.g., spin rate) from that achieved by traditional mudding techniques.

The level of grip can be correlated with the loop tack of the polyacrylate as determined by ASTM D6195-03(2019) Test Method A using an Instron model no. 5564 equipped with a 100 N load cell. In brief, "loop tack" is the force required to separate a polymer from a surface at the interface shortly after having been brought into contact under a load equal only to the weight of the polymer and backing on a 25 mm×25 mm contact area. This test method involves allowing a loop of polymer with its backing substrate to be brought into controlled contact with a 25×25 mm surface of stainless steel with the only force applied being the weight of the loop itself. The polymer is then removed from the stainless steel surface, with the corresponding maximum force to remove the polymer being measured as the loop tack. For purposes of the present description, approximately 0.7 to 0.8 mil (e.g. approximately 20 grams per square meter (gsm)—dry weight) of the subject polymer (polyacrylate) is coated on one side of a 2 mil, 175 mm PET strip and dried for approximately 5 minutes at 80° C. and then allowed to equilibrate at room temperature (approximately 23° C.) at 50% relative humidity for 60 minutes. In a series of embodiments, the subject polyacrylates have an average loop tack value (average of at least 3 test measurements) of less than 300, 200 and even 100 g when coated at a thickness of from 0.5 to 1 mil, more preferably from 0.7 to 0.8 mil. These loop tack values are much lower than conventional polyacrylate pressure sensitive adhesives which have loop tack values of greater than 500 grams when measured under the same test conditions.

The level of grip can also be correlated with the coefficient of friction (COF) of the outer surface of the leather cover. The COF of the leather used to assemble a game ball can be determined by measuring the friction between the outer surface of the leather and a rubber probe mounted on a balanced arm assembly which measures the force needed to move the rubber probe across the outer surface of the leather. The speed of the test is set at 600 mm/min. The measurement distance is pre-programmed at 40 mm. After the measurement has been completed, an analysis tool is used to calculate the coefficient of friction. Testing is conducted using a Dia-Stron™ Model No. MTT175 Miniature Tensile Tester used in conjunction with the Universal Control Unit model UV1000 and UvWin™ software. Rubber probes (product code 176.0699) can be purchased from Dia-Stron. Leather samples are tested in a controlled environment, i.e. at room temperature (approx. 23° C.) and approximately 50% relative humidity. In one class of embodiments, the COF of the leather changes less than 50%, 45% or even 40% as a result of the application of the subject polyacrylate particles. In another embodiment, the COF of the leather increases by 5 to 40% as a result of the application of the subject polyacrylate particles. This ensures that the game ball largely retains the COF associated with the untreated (i.e. no polyacrylate) leather. For context, the outer surface of an untreated leather cover has a COF of approximately 0.33 whereas in one class of embodiments, a treated (i.e. including the subject polyacrylate particles) leather cover has a COF of from 0.20 to 0.60, 0.25 to 0.55, or even 0.30 to 0.50. In another class of embodiments the outer surface of the leather cover including polyacrylate particles dispersed thereon has a COF of less than 1.00, 0.90, 0.80, 0.70, 0.60, 0.55 or even 0.5 (based upon an average using a minimum of 3 measurements).

In another embodiment, the subject polyacrylates have a dynamic shear storage modulus (G') of greater than 0.1, greater than 0.5 or greater than 1.0 MPa (e.g. from 0.1 to 15 MPa, 0.5 to 12 MPa. or 1 to 10 MPa) when measured at room temperature. Dynamic shear storage modulus measurements are performed on a TA Instruments ARES-G2 rheometer equipped with an air cooling accessory (ACS-3), using 8 mm diameter aluminum disposable plate fixtures. A Dynamic Temperature Ramp Mode is used for testing samples from 160° C. to −80° C. at a cooling rate of 2°/min using an applied frequency of 6.28 rad/s. The AutoStrain option should be employed for testing with the initial strain set at 0.5% and a maximum strain limit of 5% to ensure that the tests remain in the linear viscoelastic regime. The fixtures are zeroed at the initial test temperature of 160° C. The thickness of samples can be measured using the instrument micrometer after loading the sample between the parallel plates. Tests are started after equilibrating at 160° C. for approximately 10 to 15 minutes. The test samples may be provided as aqueous emulsions. Each emulsion is poured into a ChemWare™ petri dish and allowed to dry in a convection hood for several days. The resulting films are then flipped to expose their bottom surface to air. Dry ice may be used to facilitate removal of the film from the petri dish. The inverted films are then placed back into the convection hood for another several days. The dish with the film is then placed under vacuum at ambient temperature until the time of testing.

While the polyacrylate may be dispersed upon the outer surface of the leather cover (and optionally threads used for stitching the cover) prior to assembly of the game ball, the polyacrylate is preferably applied after the game ball is assembled, e.g., after the leather cover has been stitched about the core. The polyacrylate is preferably applied as an aqueous emulsion. The technique for applying the emulsion is not particularly limited and includes spray techniques (e.g., air-atomized spray, air-assisted spray, airless spray, high volume low pressure spray, etc.), dipping, padding, tumble drum coating, brushing, etc. In another embodiment, a relatively dilute aqueous emulsion is used, e.g. from 3 to 15% solids as compared with 20 to 30% solids used in conventional leather treatments (e.g., leather furniture, automotive leather seating, etc.). As used herein, the term "% solids" refers to the non-volatile constituents of the emulsion. Volatile constituents volatilize under ambient temperatures and standard pressure conditions. Examples of volatile constituents include organic solvents, water and ammonia. The emulsion may be applied upon the outer surface of the leather cover in one or more sequential applications. Once applied, the emulsion may be dried at elevated temperature. e.g., from 165 to 195° C. for approximately 30 to 180 seconds. Examples of the drying steps include air drying and infrared heating. If the emulsion is applied in several application steps, it is preferably dried prior to a subsequent application.

Unlike many traditional leather treatments, the subject polyacrylate is substantially reacted prior to application on the game ball, i.e., the polyacrylate does not form chemical bonds with the outer surface of the leather coating or stitching. Additionally, the subject aqueous emulsion including the polyacrylate is preferably free of organic solvents.

A representative class of polyacrylates include a repeating unit represented by Formula I.

Formula I

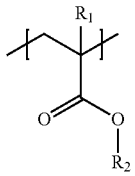

wherein $R_1$ is independently selected from hydrogen and methyl (preferably hydrogen) and $R_2$ is independently selected from hydrogen and an alkyl group having from 1 to 24 carbon atoms. Such polymers include homopolymers, copolymers, blends along with so-called "core-shell" polymers prepared by well-known multi-stage emulsion polymerization processes. Applicable polymers preferably comprise predominantly repeating units as represented by Formula I, i.e., at least 50, 60, 70, 80, 90, 95 and even 99 wt % of the total repeat units. The subject polymers may be initially provided as an aqueous emulsion prior to application to the leather of the game ball. In one class of embodiments, the emulsions include a polyacrylate having an average volume particle (droplet) size distribution (Dv50) of from 50 nm to 1000 nm, 80 nm to 500 nm or 90 nm to 300 nm as measured by laser diffraction technique using a Mastersizer 3000 with a Hydro SV attachment (Malvem Panalytical—a division of Spectris, Egham, Surrey, UK). The term "Dv" represents the average volume particle size of the dispersed particles. Dv50 is the particle size measured in volume corresponding to 50% of the cumulative particle population. This particle size range maintains the particles predominately on the surface of the leather rather than penetrating the pores of the leather.

The subject polyacrylates preferably have a weight average molecular weight (Mw) of from 10,000 to 12,000.000; 50,000 to 5,000,000 and more preferably 500,000 to U.S. Pat. No. 1,500,000 (Daltons) as determined by gel permeation chromatography (GPC). More particularly, GPC separations may be conducted using an Agilent 1260 system consisting of the pump, degasser, autosampler and Wyatt T-rEX refractive index (RI) detector operated at 35° C. The system is preferably equipped with a column set consisting of two Shodex KF-806L columns (8 mm I.D.×300 mm length), temperature maintained at 35° C. A mobile phase of tetrahydrofuran/formic acid (THF/FA) at a ratio of 100:5 is flown at a rate of 1 mL/min. Samples can be prepared at 2 mg/mL in THF/FA shaken for several hours at room temperature until fully dissolved and then filtered prior to analysis (0.45 μm PTFE w/GMF filter), sample injection volume was 100 μL and run length was 30 minutes. The column is calibrated with a set of narrow polystyrene (PS) standards purchased from Agilent (EasiCal PS-1). System control, data acquisition and processing are performed using Astra software from Wyatt.

In another embodiment, the subject polyacrylates have a glass transition temperature (Tg) as determined by dynamic mechanical analysis (DMA) of less than 20° C. and more preferably less than 10° C. and still more preferably less than 0° C. DMA measurements are performed on a TA Instruments ARES-G2 rheometer equipped with an air cooling accessory (ACS-3), using 8 mm diameter aluminum disposable plate fixtures. A Dynamic Temperature Ramp Mode is used for testing the samples from 160° C. to −80° C. at a cooling rate of 2 deg/min, using an applied frequency of 6.28 rad/s. The AutoStrain option is employed for testing with the initial strain set at 0.5% and a maximum strain limit of 5% to ensure that the test remains in the linear viscoelastic regime. The fixtures are zeroed at the initial test temperature of 160° C. The thickness of the sample is measured using the instrument micrometer after loading the sample between the parallel plates. Testing is started after equilibrating at 160° C. for approximately 10-15 min. The dynamic storage and loss moduli (G' and G", respectively) along with tan S(=G"/G') are recorded as a function of temperature for each sample. The Tg is determined as the peak temperature from tan S. For multi-stage polymers and blends, the "polymer" may exhibit multiple glass transition temperatures corresponding to each polymer component. For example, for a classic two-stage polymer, the first stage (core) may comprise a relatively soft polymer having Tg of from −70 to 10° C. (more preferably −45 to 10° C.) and comprise over 50 wt % of the total weight of the multi-stage polymer, and a second stage (shell) that comprises a relatively hard polymer having a Tg of from 20 to 150° C. and comprising less than 50 wt % of the total weight of the multi-stage polymer, e.g. from 5 to 25 wt % of the total weight of the multi-stage polymer. For purposes of multi-stage polymers and blends, the Tg may be expressed as a weighted value based upon the relative weight of each individual polymer component (i.e. each individual polymeric stage and/or blend component). For copolymer components, the weighted average Tg may be calculated using the using the well-known Fox equation: $I/T_g=w_1/T_{g(1)}+w_2/T_{g(2)}$, where $w_1$ and $w_2$ refer to the weight fraction of the two comonomers, and $T_{g(1)}$ and $T_{g(2)}$ refer to the glass transition temperatures of the two corresponding homopolymers in Kelvin. For polymers containing three or more monomers, additional terms are added ($w_n/T_{g(n)}$). In the absence of actual measured Tg values, the Tg of a polymer phase can be calculated by using the values for the glass transition temperatures of homopolymers reported in the literature. e.g., in the Polymer Handbook. 4th edition, edited by J. Brandrup, E. H. Immergut and E. A. Grulke, John Wiley and Sons, New York. Thus, the subject polyacrylate may comprise one or more polyacrylate components. When multiple components are present, the glass transition temperature (Tg) of the polyacrylate component comprising more than 50 wt %, 60 wt % and in some embodiments 75 wt % of the total weight of polyacrylate is less than 20° C., less than 10° C. and in some embodiments less than 0° C.

Applicable polyacrylates are classically derived from the polymerization (e.g. free-radical polymerization) of monoethylenically unsaturated organic monomers and optionally multi-ethylenically unsaturated organic monomers. See for example U.S. Pat. No. 7,323,500 and U.S. Ser. No. 10/100,377. As used herein: the term (i) "monoethylenically unsaturated organic monomer" (preferably an α-monoethylenically unsaturated monomer) refers to a compound comprising a single polymerizable carbon-carbon double bond which under appropriate reaction conditions, is subject to free radical polymerization and the term (ii) "multi-ethylenically unsaturated organic monomer" refers to a compound comprising at least two polymerizable carbon-carbon double bonds which under appropriate reaction conditions, are subject to free radical polymerization. Also, as used herein, the use of the term "(meth)" followed by another term such as acrylate refers to both acrylates and methacrylates. For example, the term "(meth)acrylate" refers to either acrylate or methacrylate; the term "(meth) acrylic" refers to either acrylic or methacrylic; and the term "(meth)acrylamide" refers to either acrylamide or methacrylamide.

Examples of suitable ethylenically unsaturated monomers include (meth)acrylates such as $C_1$ to $C_{24}$ alkyl(meth)acrylates, hydroxyalkyl(meth)acrylates, and ionic (meth)acrylates such as acid containing (meth)acrylates, amine containing (meth)acrylates, and amide containing (meth) acrylates. Suitable $C_1$ to $C_{24}$alkyl(meth)acrylates include methyl(meth)acrylate, ethyl(meth)acrylate, butyl(meth) acrylate, 2-ethylhexyl(meth)acrylate, decyl(meth)acrylate, lauryl(meth)acrylate, and stearyl(meth)acrylate. Suitable hydroxyalkyl(meth)acrylates include hydroxyethyl(meth) acrylate and hydroxypropyl(meth)acrylate. Examples of other suitable ethylenically unsaturated monomers are acid containing monomers including acid containing (meth)acrylates such as, for example, (meth)acrylic acid and phosphoethyl(meth)acrylate: difunctional acids such as itaconic acid; maleic acid, as well as anhydrides such as maleic anhydride, which form acids in the presence of water. Other suitable ethylenically unsaturated monomers include styrene; substituted styrenes such as alpha-methyl styrene; vinyl acetate or other vinyl esters; vinyl monomers such as vinyl chloride, vinylidene chloride. N-vinyl pyrrolidone; and (meth)acrylonitrile. Still other suitable ethylenically unsaturated monomers include multi-ethylenically unsaturated monomers such as, for example, allyl(meth)acrylate, diallyl phthalate, 1,4-butylene glycol di(meth)acrylate, 1,2-ethylene glycol di(meth)acrylate, 1,6-hexanediol di(meth)acrylate, and divinyl benzene; and crosslinking monomers such as methylol (meth)acrylamide, acetoacetate monomers, and acetoacetamide monomers. Examples of acetoacetate monomers include vinyl acetoacetate, acetoacetoxyethyl (meth)acrylate, acetoacetoxy propyl (meth)acrylate, allyl acetoacetate, aetoacetoxybutyl(meth)acrylate, and 2,3-di)acetoacetoxy) propyl (meth) acrylate. Examples of acetoacetamide monomers include vinyl acetoacetamide and acetoacetoxyethyl (meth)acrylamide.

As mentioned, the applicable polyacrylate may be prepared using conventional aqueous emulsion polymerization processes. In such emulsion polymerization processes, conventional surfactants may be used such as, for example, anionic and/or nonionic emulsifiers such as, for example, alkali metal or ammonium alkyl sulfates, alkyl sulfonic acids, fatty acids, and oxyethylated alkyl phenols, the amount of surfactant used is usually in the range of from 0.1 to 6% by weight, based on the weight of monomer. Either thermal or redox initiation processes may be used. The monomer mixture may be added neat or as an emulsion in water. The monomer mixture may be added in one or more additions or continuously over the reaction period allotted. Conventional thermal free radical initiators which can be used include hydrogen peroxide, sodium peroxide, potassium peroxide, t-butyl hydroperoxide, cumene hydroperoxide, ammonium and/or alkali metal persulfates, sodium perborate, perphosphoric acid and salts thereof, potassium permanganate, and ammonium or alkali metal salts of peroxydisulfuric acid. These initiators are typically used at a level of 0.01 to 3.0 wt % based on the total weight of monomer. Redox initiators which can be used are typically an oxidant plus a reducing agent in combinations effective to generate free radicals, including the same free radical initiators listed above as the oxidant; and a suitable reductant such as sodium sulfoxylate formaldehyde, ascorbic acid, isoascorbic acid, alkali metal and ammonium salts of sulfur-containing acids such as sodium sulfite, bisulfite, thiosulfate, hydrosulfite, sulfide, hydrosulfide or dithionite, formamidine sulfinic acid, hydroxymethane sulfonic acid, acetone bisulfite: amines such as ethanolamine, glycolic acid, glyoxylic acid hydrate, lactic acid, glyceric acid, malic acid, tartaric acid, as well as salts of the preceding acids which may be used. Redox reaction catalyzing metal salts of iron, copper, manganese, silver, platinum, vanadium, nickel, chromium, palladium, or cobalt may optionally be used. The initiator or initiator system can be added in one or more additions, continuously, linearly, or not, over the reaction period, or as combinations thereof. Several azo-type organic free radical initiators which can be used in the monomer swell process such as azobis-isobutyronitrile and azobispropionitrile. Chain transfer agents such as mercaptans may be used to lower the molecular weight of the polymer.

The emulsion polymerization may be conducted a single polymerization stage, or as a multistage polymerization process in which two or more polymeric stages varying in composition are prepared in sequential fashion. The polymerization techniques used to prepare such aqueous multistage polymer particles are well known in the art, such as, for example, U.S. Pat. Nos. 4,325,856, 4,654,397, 4,814,373, 5,723,182, 7,323,500 and U.S. Ser. No. 10/100,377.

Many embodiments of the invention have been described and, in some instances, certain embodiments, selections, ranges, constituents, or other features have been characterized as being "preferred." Such designations of "preferred" features should in no way be interpreted as an essential or critical aspect of the invention. Expressed ranges specifically include designated end points.

EXAMPLES

Unless otherwise indicated, all preparation and testing were conducted at room temperature (RT) at standard pressure (I atm or 760 mm Hg) using the test methods as described above.

Example 1

A monomer emulsion was prepared by mixing deionized (DI, 29 parts) water, anionic surfactant (sodium lauryl sulfate 2 parts) ethyl acrylate (EA, 94 parts), and acrylic acid (AA, 4 parts). To a four-necked round bottom flask equipped with a paddle stirrer, a thermometer, nitrogen inlet, and a reflux condenser was added DI water (118 parts). The monomer emulsion was then added to the flask and initiated with a redox pair (ammonium persulfate and sulfite reducer). The temperature was controlled to less than 96° C. After the reaction was complete, the batch was held at temperature for 15 minutes then cooled 60° C. Residual monomers were reduced with the addition of a redox pair (t-butyl hydroperoxide and sulfite reducer) during cooling and the batch was neutralized with ammonia (30% aqueous solution) and 1.8 parts of zinc oxide to pH 7.5. Particle size was approximately 80 nm. The Tg was approximately −19° C. as calculated by the Fox equation. The emulsion had 35% solids.

Example 2

A monomer emulsion was prepared by mixing deionized (DI, 29 parts) water, anionic surfactant (sodium lauryl sulfate, 2 parts), butyl acrylate (BA, 40 parts), ethyl acrylate (EA, 54 parts), and acrylic acid (MAA, 6 parts). To a four-necked round bottom flask equipped with a paddle stirrer, a thermometer, nitrogen inlet and a reflux condenser was added DI water (118 parts). The monomer emulsion was then added to the flask and initiated with a redox pair (ammonium persulfate and sulfite reducer). The temperature was controlled to less than 97° C. After the reaction was complete, the batch was held at temperature for 15 minutes then cooled 60° C. Residual monomers were reduced with the addition of a redox pair (t-butyl hydroperoxide and sulfite reducer) during cooling and the batch was neutralized with ammonia (30% aqueous solution) and 2.7 parts of zinc oxide to pH 7.5. Particle size was approximately 80 nm. Tg was approximately −32° C. as calculated by the Fox equation. The emulsion had 34% solids.

Example 3

A monomer emulsion was prepared by mixing deionized (DI, 26 parts) water, anionic surfactant (sodium lauryl sulfate and dodecylbenzene sulfonate 1.5 parts total), butyl acrylate (BA, 77 parts) and methacrylic acid (MAA, 3 parts). To a four-necked round bottom flask equipped with a paddle stirrer, a thermometer, nitrogen inlet, and a reflux condenser was added DI water (97 parts). The monomer emulsion was then added to the flask along with a concurrent and separate addition of an aqueous redox initiator pair (ammonium persulfate and sulfite reducer). The temperature was controlled to less than 88° C. by adjusting feed rate. After the reaction was complete, the batch was cooled to 64° C. then MMA (20 parts) was added with another portion of aqueous redox initiator pair. The batch was allowed to react and then held for 15 minutes before cooling. Residual monomers were reduced with the addition of a redox pair (t-butyl hydroperoxide and sulfite reducer) during cooling and the batch was neutralized with triethyl amine to a pH of 7.5. Particle size was approximately 105 nm. Tg values were approximately −49.6° C. (core) and 105° C. (shell) as calculated by the Fox equation. The emulsion had 36% solids.

Example 4: Pressure Sensitive Adhesive

A polyacrylate emulsion based upon 98 wt % butyl acrylate monomer and 2 weight percent methacrylic acid was prepared as described in Example 2, sample 2 of U.S. Pat. No. 3,740,366. Particle size was approximately 381 nm. Tg was approximately −52° C. as calculated by the Fox equation.

Selected Properties of Examples:

| Example No. | Glass Trans. Temp. (Tg) | Particle size | Dynamic shear storage modulus (G') @ 4.4° C. | Dynamic shear storage modulus (G') @ 21.1° C. | *Loop Tack (standard dev.) Coat weight & thickness | |
|---|---|---|---|---|---|---|
| 1 | −19° C. | 80 nm | 7.3 MPa | 1.3 MPa | 49 g (18) | 19.8 gsm (0.75 mil) |
| 2 | −32° C. | 80 nm | 3.7 MPa | 1.9 MPa | 60 g (32) | 21.0 gsm (0.79 mil) |
| 3 | −49.6° C. (core) 105° C. (shell) | 105 nm | 9.8 MPa | 6.0 MPa | 37 g (12) | 20.6 gsm (0.78 mil) |
| 4 | −52° C. | 381 nm | 0.126 MPa | 0.071 MPa | 511 g (96) | 18.4 gsm (0.70 mil) |

*average values based upon 5 measurements. Loop tack of PET without polyacrylate was approx. 22 g.

Example 5

Samples of leather used for making covers of game balls were tested to determine their coefficient of friction (COF) according to the methodology previously described. Measurements were made on untreated control samples along with leather samples treated with polyacrylate particles of Examples 1-4. The treatment involved spraying an aqueous emulsion (at 5% solids) of each of the polyacrylates described in Examples 1-4. Two successive spray treatments were applied to achieve a total dry solid loading level of approximately 110 mg/ft$^2$ per sample. The treated samples were dried at 185° C. for two minutes between each spray application. The results of the testing are provided in the table below.

Coefficient of Friction (COF) of Leather Samples:

| Example No. | COF (Standard deviation) |
|---|---|
| Control (untreated leather) | 0.33 (0.02) |
| 1 | 0.32 (0.02) |
| 2 | 0.33 (0.02) |
| 3 | 0.44 (0.03) |
| 4 | 1.26 (0.13) |

Example 6

New (untreated) game balls were treated by spraying the aqueous emulsion (at 5% solids) of Example 3. Four successive spray treatments were applied to the sample game balls to achieve a total dry solid loading level of approximately 50 to 60 mg per ball. The treated samples were dried at 185° C. for two minutes between each spray application. The samples were then subjected to FTIR analysis as per the methodology previously described using four equal distance sample locations per ball. A leather peak (1643 cm$^{-1}$) intensity of −0.011 (std. dev. 0.006) and a polyacrylate peak (1732 cm$^{-1}$) intensity of −0.130 (std. dev. 0.060) were observed.

The invention claimed is:

1. A game ball comprising a leather cover secured about a solid core, wherein the leather cover includes an inner surface contacting the solid core and an opposing outer surface, wherein the game ball is characterized by including polyacrylate particles dispersed on but not encased about the outer surface of the leather cover;

wherein the outer surface of the leather cover is characterized by having a Fourier transform infrared (FTIR) spectra with peaks corresponding to leather and polyacrylate and wherein a peak intensity ratio between the polyacrylate and leather peaks is from 0.10 to 50.0.

2. The game ball of claim 1 where the leather cover comprises from 10 to 150 mg of polyacrylate particles dispersed thereon.

3. The game ball of claim 1 where the leather cover comprises from 10 to 100 mg of polyacrylate particles dispersed thereon.

4. The game ball of claim 1 wherein said outer surface of the leather cover is characterized by having a coefficient of friction (COF) of less than 1.

5. The game ball of claim 1 wherein the polyacrylate comprises one or more polyacrylate components and wherein the glass transition temperature (Tg) of the polyacrylate components comprising more than 50 wt % of the total weight of polyacrylate is less than 20° C.

6. The game ball of claim 1 wherein the polyacrylate particles have an average volume particle size distribution (Dv50) of from 80 nm to 500 nm.

7. The game ball of claim 1 wherein the polyacrylate has dynamic shear storage modulus (G') of greater than 0.5 MPa when measured at room temperature.

8. The game ball of claim 1 wherein the polyacrylate has loop tack less than 200 g.

9. The game ball of claim 1 wherein the polyacrylate particles have a weight average molecular weight (Mw) of from 10,000 to 12,000,000.

10. The game ball of claim 1 wherein the polyacrylate particles comprise a polyacrylate including a repeating unit represented by Formula I Formula I

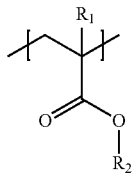

wherein $R_1$ is independently selected from hydrogen and methyl and $R_2$ is independently selected from hydrogen and an alkyl group having from 1 to 24 carbon atoms.

11. A method of treating a game ball comprising the steps of:

i) obtaining a game ball comprising a leather cover secured about a solid core, wherein the leather cover includes an inner surface contacting the solid core and an opposing outer surface, and ii) dispersing polyacrylate particles on the outer surface of the leather cover wherein the polyacrylate particles are dispersed the outer surface of the leather cover such that the leather cover has a Fourier transform infrared (FTIR) spectra with peaks corresponding to both leather and polyacrylate and wherein a peak intensity ratio between the polyacrylate and leather peaks is from 0.10 to 50.0.

* * * * *